US006422422B1

(12) United States Patent
Forbes

(10) Patent No.: US 6,422,422 B1
(45) Date of Patent: Jul. 23, 2002

(54) AUTOMATIC BAR

(76) Inventor: Ludlow D. Forbes, 351 South Broad St., Elizabeth, NJ (US) 07202

( * ) Notice: Subject to any disclaimer, the term of this patent is extended or adjusted under 35 U.S.C. 154(b) by 0 days.

(21) Appl. No.: 09/664,572

(22) Filed: Sep. 18, 2000

(51) Int. Cl.[7] ..... B67D 5/56
(52) U.S. Cl. ..... 222/66; 222/129.1; 222/144.5
(58) Field of Search ..... 222/66, 129, 129.1, 222/144.5

(56) References Cited

U.S. PATENT DOCUMENTS

| | | | | | |
|---|---|---|---|---|---|
| 4,162,028 | A | * | 7/1979 | Reichenberger | 222/144.5 |
| 5,152,429 | A | * | 10/1992 | Billings | 222/144.5 |
| 5,230,443 | A | * | 7/1993 | Du | 222/144.5 |
| 5,731,981 | A | * | 3/1998 | Simard | 222/144.5 |
| 6,142,340 | A | * | 11/2000 | Wantanabe et al. | 222/66 |

FOREIGN PATENT DOCUMENTS

| | | | | |
|---|---|---|---|---|
| GB | 2180939 | * | 4/1987 | 222/66 |

* cited by examiner

*Primary Examiner*—Joseph A. Kaufman
(74) *Attorney, Agent, or Firm*—Walter J. Tencza, Jr.

(57) ABSTRACT

An apparatus is disclosed comprising a plurality of liquid containers and a corresponding plurality of tubes. Each liquid container has an opening into which is inserted the first end of a corresponding tube. The second end of each tube is connected to a pumping device. A processor, connected to the pumping device, in response to a first signal, selects a first liquid container of the plurality of liquid containers and causes the pumping device to cause liquid to be pumped out of the first liquid container through its opening through the first end of the corresponding tube and out the second end of the corresponding tube. The plurality of liquid containers may be comprised of a first set of liquid containers which contains wine, second set which contains hard liquor, a third set which contains beer, a fourth set which includes chasers, and a fifth set which includes a keg of beer. The apparatus may include a housing wherein the plurality of liquid containers are stored in the housing. The housing may contain a plurality of compartments. Each compartment may only contain liquid containers having a particular type of liquid. For example, the first compartment may only include liquid containers with beer, the second wine, the third hard liquor, the fourth chasers, and the fifth beer kegs. Each compartment may include a plurality of cubicles, one cubicle for each liquid container. The size of the cubicles and/or the number of cubicles within a compartment may be able to be adjusted. The apparatus may also include a remote control signal receiver which is electrically connected to the processor and which supplies the processor with the first signal in response to a remote control signal. The apparatus may also include a plurality of selection lights, one for each corresponding liquid container of the plurality of liquid containers. The apparatus may also include a plurality of depletion sensing device, one for each corresponding liquid container of the plurality of liquid containers.

23 Claims, 7 Drawing Sheets

AUTOMATIC BAR

FIELD OF THE INVENTION

This invention relates to improved methods and apparatus for providing beverages.

BACKGROUND OF THE INVENTION

Various vending machines are known for providing such items as candy and cigarettes.

SUMMARY OF THE INVENTION

The present invention in one embodiment discloses an apparatus comprising a plurality of liquid containers and a corresponding plurality of tubes. Each liquid container has an opening. Each tube has a first end which is inserted into a corresponding opening of a corresponding liquid container and a second end which is connected to a pumping device. A processor is provided which is electrically connected to the pumping device. The processor in response to a first signal selects a first liquid container of the plurality of liquid containers and causes the pumping device to cause liquid to be pumped out of the first liquid container through its opening through the first end of the corresponding tube and out the second end of the corresponding tube.

The plurality of liquid containers may be comprised of a first set of liquid containers which contains wine, second set which contains hard liquor, a third set which contains beer, a fourth set which includes chasers, and a fifth set which includes a keg of beer.

The apparatus of the present invention may be further comprised of a housing wherein the plurality of liquid containers are stored in the housing. The housing may contain a plurality of compartments. Each compartment may only contain liquid containers having a particular type of liquid. For example, the first compartment may only include liquid containers with beer, the second wine, the third hard liquor, the fourth chasers, and the fifth beer kegs. Each compartment may include a plurality of cubicles, one cubicle for each liquid container. The size of the cubicles and/or the number of cubicles within a compartment may be able to be adjusted.

The apparatus may also include a remote control signal receiver which is electrically connected to the processor and which supplies the processor with the first signal in response to a remote control signal. The apparatus may also include a plurality of selection lights, one for each corresponding liquid container of the plurality of liquid containers. Each light of the plurality of selection lights may turn on when its corresponding first liquid container is selected.

The apparatus may also include a plurality of depletion sensing device, one for each corresponding liquid container of the plurality of liquid containers. Each depletion sensing device is electrically connected to the processor and each depletion sensing device provides an indication of whether its corresponding liquid container has been virtually depleted of liquid. The processor may receive an indication of depletion from one of the depletion sensing devices and may prevent the pumping device from attempting to pump liquid from the corresponding liquid container.

The present invention in one embodiment houses in one centralized unit all the potential equipment and dispensing mechanisms needed to make anyone a drink. In one embodiment a free standing glass front unit with compartments for liquor bottles and chaser bottles of various sizes is provided.

DETAILED DESCRIPTION OF THE DRAWINGS

Figure 1:
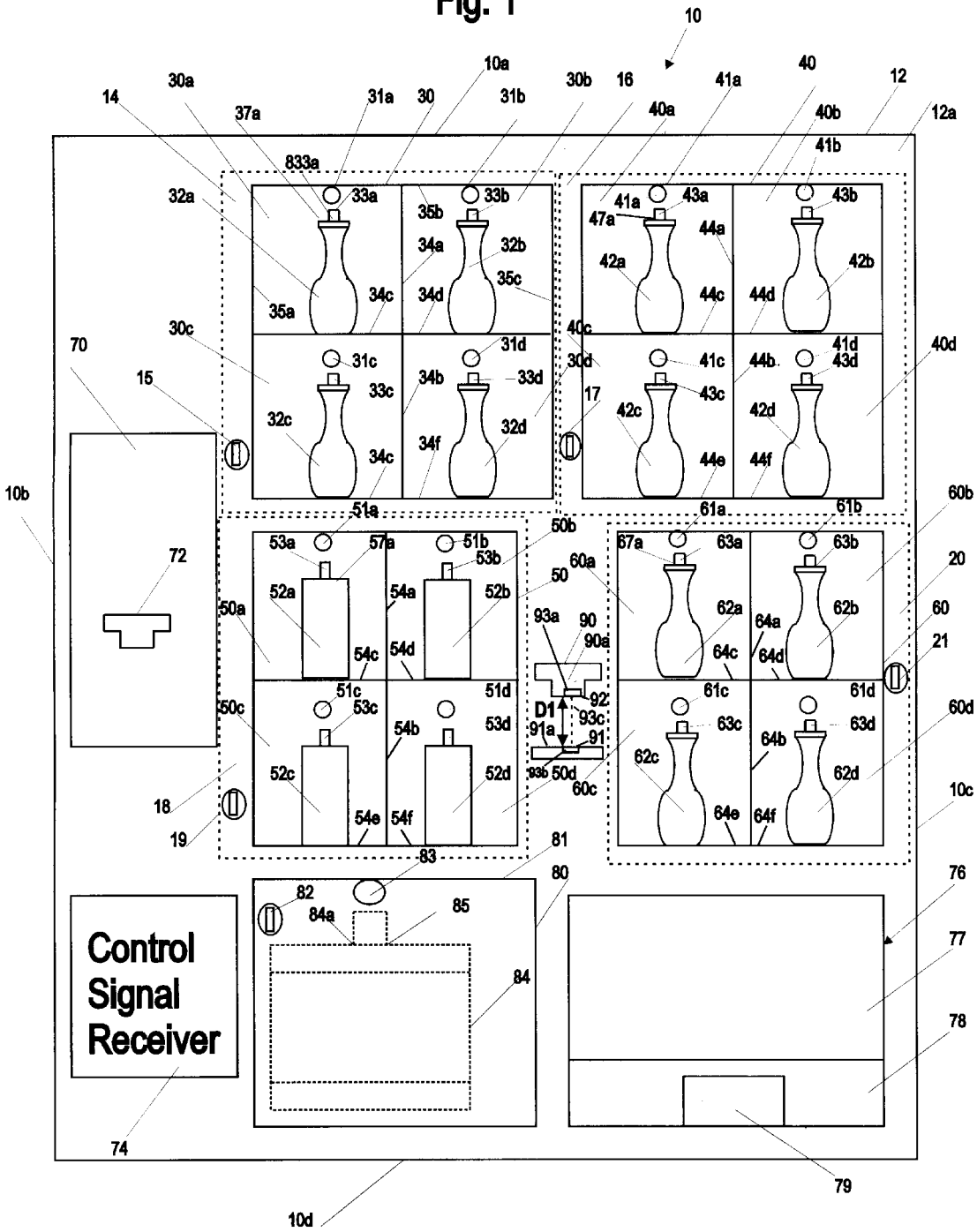
FIG. 1 shows a front planar view of an apparatus for dispensing beverages in accordance with an embodiment of the present invention.

FIG. 1 shows a front planar view of an apparatus 10 for dispensing beverages in accordance with an embodiment of the present invention. The apparatus 10 is comprised of housing 12 which includes front housing 12*a*. The apparatus 10 is also comprised of compartments 30, 40, 50, and 60. The apparatus 10 is also comprised of an ice and water maker 70, a glass washing and dispensing device 76, a beer keg compartment 80, and a control signal receiver 74, as shown in FIG. 1.

Each compartment of 30, 40, 50 and 60 has a glass door which prevents an individual from taking something out of the compartment. Doors 14, 16, 18, and 20 cover compartments 30, 40, 50, and 60, respectively. Doors 14, 16, 18, and 20 have locks 15, 17, 19, and 21 which can be opened by a key. The doors 14, 16, 18, and 20 may be glass doors so the beverages can be seen, while the door 81 may be a solid door so that the beer keg 84 can not be seen.

Compartment 30 includes cubicles 30*a*, 30*b*, 30*c* and 30*d*. The compartment 30 also includes shelves 34*a*, 34*b*, 34*c*, 34*d*, 34*e*, and 34*f*. Shelves 34*a* and 34*b* may actually be connected together and be one shelf as may be shelves 34*e* and 34*f*. The compartment 30 may be designated as the wine compartment. The compartment 30 may include wine bottles 32*a*, 32*b*, 32*c*, and 32*d*. Each wine bottle has a tube placed in its top opening. Wine bottle 32*a* has a tube 33*a* placed in its top opening 37*a*. Similarly wine bottles 32*b* through 32*d* have tubes 33*b* through 33*d*, respectively placed in their top openings. Each wine bottle 32*a* through 32*d* may contain a different wine.

The compartment 30 can be refrigerated to keep the wine bottles 32*a* through 32*d* cool. The door 14 may provide a seal when closed and locked shut, like a refrigerator door.

Compartment 40 includes cubicles 40*a*, 40*b*, 40*c* and 40*d*. The compartment 40 also includes shelves 44*a*, 44*b*, 44*c*, 44*d*, 44*e*, and 44*f*. Shelves 44*a* and 44*b* may actually be connected together and be one shelf as may be shelves 44*e* and 44*f*. The compartment 40 may be designated as the hard liquor compartment. "Hard Liquor" would include whiskey, rum, scotch and other liquors as known in the art but would not include beer or wine. The compartment 40 may include hard liquor bottles 42*a*, 42*b*, 42*c*, and 42*d*. Each hard liquor bottle has a tube placed in its top opening. Hard liquor bottle 42*a* has a tube 43*a* placed in its top opening 47*a*. Similarly hard liquor bottles 42*b* through 42*d* have tubes 43*b* through 43*d*, respectively placed in their top openings. Each hard liquor bottle 42*a* through 42*d* may contain a different hard liquor.

Compartment 50 includes cubicles 50*a*, 50*b*, 50*c* and 50*d*. The compartment 50 also includes shelves 54*a*, 54*b*, 54*c*, 54*d*, 54*e*, and 54*f*. Shelves 54*a* and 54*b* may actually be connected together and be one shelf as may be shelves 54*e* and 54*f*. The compartment 50 may be designated as the beer compartment. The compartment 50 may include beer bottles or cans 52*a*, 52*b*, 52*c*, and 52*d*. Each beer bottle has a tube placed in its top opening. Beer bottle 52*a* has a tube 53*a* placed in its top opening 57*a*. Similarly beer bottles 52*b* through 52*d* have tubes 53*b* through 53*d*, respectively placed in their top openings. Each beer bottle 52*a* through 52*d* may contain a different beer.

Compartment 60 includes cubicles 60*a*, 60*b*, 60*c* and 60*d*. The compartment 60 also includes shelves 64*a*, 64*b*, 64*c*, 64*d*, 64*e*, and 64*f*. Shelves 64*a* and 64*b* may actually be connected together and be one shelf as may be shelves 64*e* and 64*f*. The compartment 60 may be designated as the chaser compartment. "Chasers" would include, for example tonic water and orange juice. The compartment 60 may include chaser bottles 62*a*, 62*b*, 62*c*, and 62*d*. Each chaser bottle has a tube placed in its top opening. Chaser bottle 62*a* has a tube 63*a* placed in its top opening 67*a*. Similarly chaser bottle 62*b* through 62*d* have tube 63*b* through 63*d*, respectively placed in their top openings. Each chaser bottle 62*a* through 62*d* may contain a chaser. The "chasers" would normally be non-alcoholic.

The ice and water maker 70 includes a spigot 72 from which ice or water can be obtained. The glass washing and dispensing device 76 includes a glass washing device 77 and a glass dispensing device 78. The glass dispensing device may include an opening 79 for dispensing a glass. The beer keg compartment 80 may include a beer keg 84 which is hidden behind a solid door 81. The solid door 81 can be opened by opening lock 82. The keg 84 has a tube 85 placed in a top opening 84*a* of the keg 84.

Each of the different beverage containers or bottles in FIG. 1 has a light above it which can be turned on by selecting the particular beverage. Lights 31*a*, 31*b*, 31*c*, 31*d*, 41*a*, 41*b*, 41*c*, 41*d*, 51*a*, 51*b*, 51*c*, 51*d*, 61*a*, 61*b*, 61*c*, 61*d*, and 83 are provided for bottles or beverage containers 32*a*, 32*b*, 32*c*, 32*d*, 42*a*, 42*b*, 42*c*, 42*d*, 52*a*, 52*b*, 52*c*, 52*d*, 62*a*, 62*b*, 62*c*, 62*d*, and 84 respectively.

Figure 2:
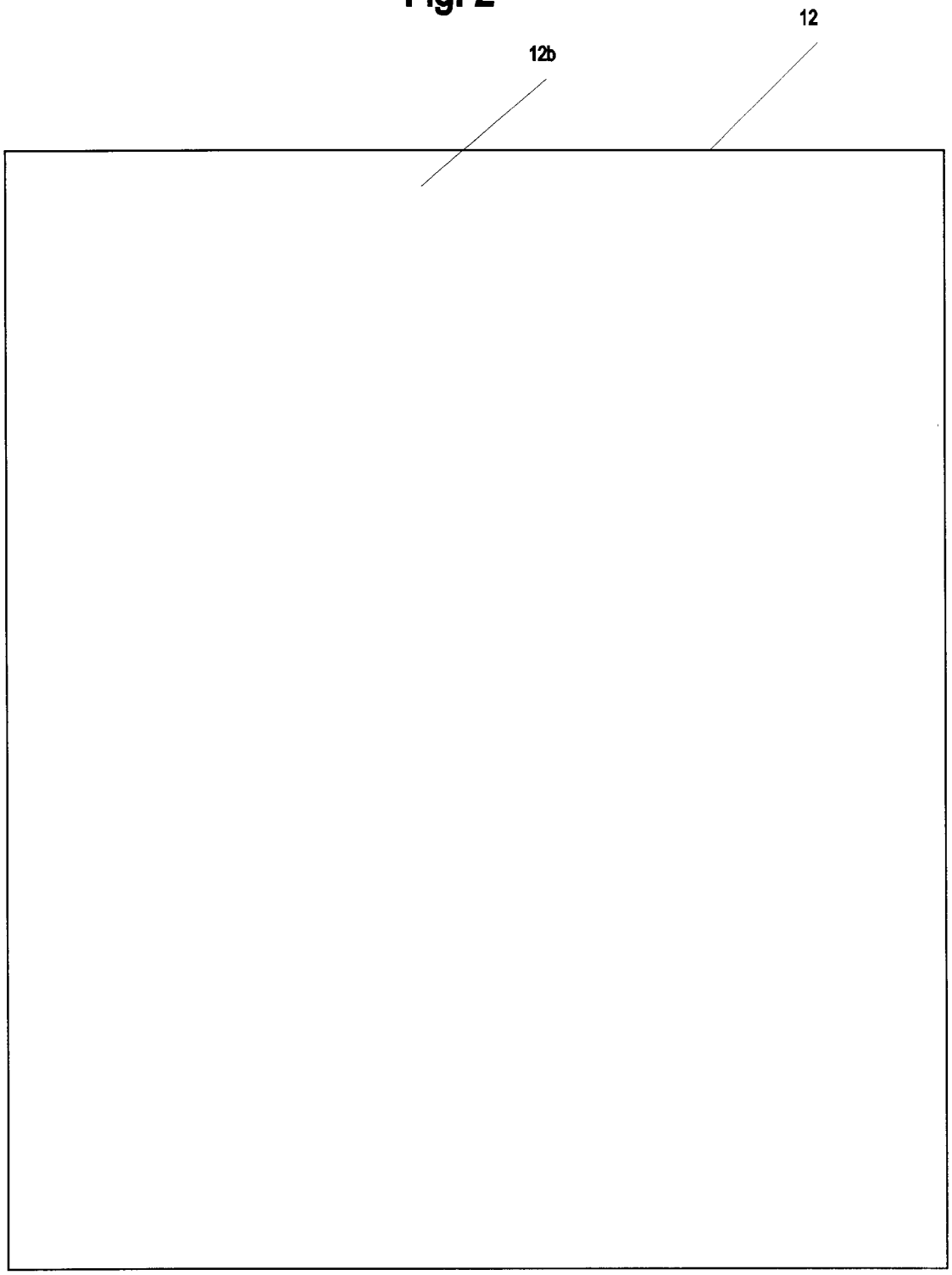
FIG. 2 shows a rear planar view of the apparatus of FIG. 1.

FIG. 2 shows a rear planar view of the apparatus 10 of FIG. 1. The rear side 12*b* of housing 12 is preferably closed so that the beverage containers or bottles, like bottles 32*a–d*, cannot be obtained without having an appropriate key to, for example, lock 15. The apparatus 10 can be box shaped with the top side 10*a*, bottom side 10*d*, left side 10*b*, and right side 10*c*, identified in FIG. 1 (but not completely shown in three dimensions) also being closed.

Figure 3:
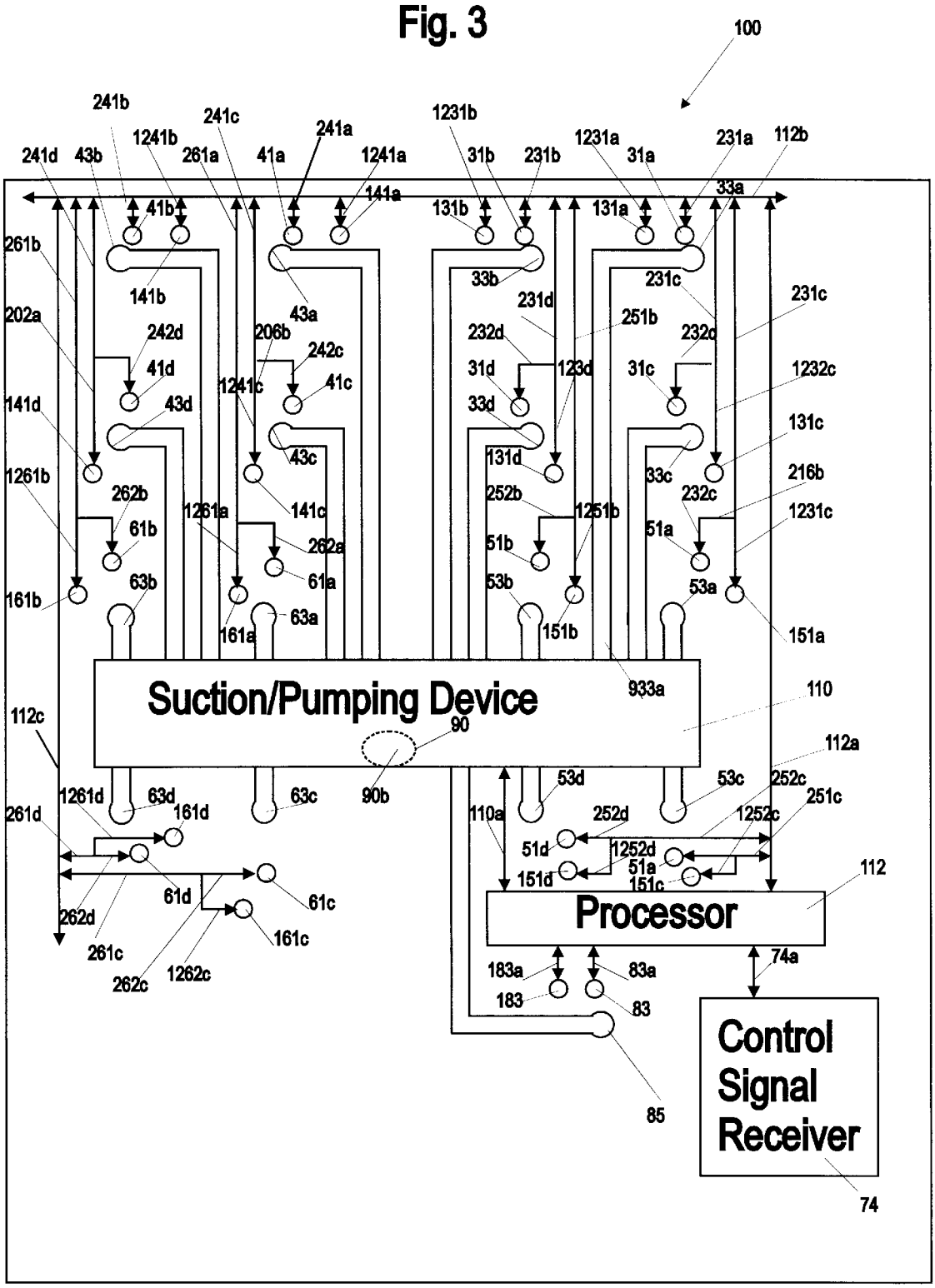
FIG. 3 is a simplified diagram of various components of the apparatus of FIG. 1.

FIG. 3 is a simplified diagram of various components of the apparatus 10 of FIG. 1. FIG. 3 shows a pumping device 110, a processor 112, and the signal receiver 74. FIG. 3 also shows depletion sensors 131*a*, 131*b*, 131*c*, 131*d*, 141*a*, 141*b*, 141*c*, 141*d*, 151*a*, 151*b*, 151*c*, 151*d*, 161*a*, 161*b*, 161*c*, 161*d*, and 183 which correspond to bottles or beverage containers 32*a*, 32*b*, 32*c*, 32*d*, 42*a*, 42*b*, 42*c*, 42*d*, 52*a*, 52*b*, 52*c*, 52*d*, 62*a*, 62*b*, 62*c*, 62*d*, and 84 respectively. Each bottle or beverage container has its own depletion sensor. FIG. 3 also shows the tubes 33*a*, 33*b*, 33*c*, 33*d*, 43*a*, 43*b*, 43*c*, 43*d*, 53*a*, 53*b*, 53*c*, 53*d*, 63*a*, 63*b*, 63*c*, 63*d*, and 83. Although part of these tubes peaks out in the front view of FIG. 1, most of each of these tubes is located inside the housing 12 of the apparatus 10 as shown by FIG. 3. The tubes 33*a–d*, 43*a–d*, 53*a–d*, 63*a–d*, and 83 are each connected at one end to a bottle or beverage container as shown in FIG. 1 and at their other end to the pumping device 110. For example tube 33*a* is connected at its end 833*a* shown in FIG. 1 to the bottle 32*a* and connected at its end 933*a* in FIG. 3 to the pumping device 110 shown in FIG. 3.

The pumping device 110 is electrically connected to the processor 112 by data bus 219 as shown in FIG. 3. The lights 31*a*, 31*b*, 41*a* and 41*b* are electrically connected to the main data busses 112*a*, 112*b*, and 112*c* of the processor 112 by data busses 231*a*, 231*b*, 241*a*, and 241*b* respectively. The depletion sensors 131*a*, 131*b*, 141*a* and 141*b* are electrically connected to the processor 112 by data busses 1231*a*, 1231*b*, 1241*a*, and 1241*b* respectively.

The lights 31*c*, 31*d*, 41*c* and 41*d* are electrically connected to the main data busses 112*a*, 112*b*, and 112*c* of the processor 112 by data busses 231*c* and 232*c*, 231*d* and 232*d*, 241*c* and 242*d*, and 241*d* and 242*d*, respectively. The depletion sensors 131*c*, 131*d*, 141*c* and 141*d* are electrically connected to the data busses 112*a*, 112*b*, and 112*c* of the processor 112 by data busses 231*c* and 1231*d*, 231*d* and 1231*d*, 241*c* and 1241*c*, 241*d* and 1241*d* respectively.

The lights 51*a*, 51*b*, 61*a* and 61*b* are electrically connected to the main data busses 112*a*, 112*b*, and 112*c* of the processor 112 by data busses 251*a* and 252*a*, 251*b* and 252*b*, 261*a* and 262*a*, and 261*b* and 262*b*, respectively. The depletion sensors 151*a*, 151*b*, 161*a* and 161*b* are electrically connected to the data busses 112*a*, 112*b*, and 112*c* of the processor 112 by data busses 251*a* and 1251*a*, 251*b* and 1251*b*, 261*a* and 1261*a*, 261*b* and 1261*b* respectively.

The lights 51*c*, 51*d*, 61*c* and 61*d* are electrically connected to the main data busses 112*a*, 112*b*, and 112*c* of the processor 112 by data busses 251*c* and 252*c*, 251*d* and 252*d*, 261*c* and 262*c*, and 261*d* and 262*d*, respectively. The depletion sensors 151*c*, 151*d*, 161*c* and 161*d* are electrically connected to the data busses 112*a*, 112*b*, and 112*c* of the processor 112 by data busses 251*c* and 1251*c*, 251*d* and 1251*d*, 261*c* and 1261*c*, 261*d* and 1261*d* respectively.

Part of the control signal receiver 74 protrudes out in FIG. 1 so that it can receive a remote control wireless signal from a hand held remote control. The control signal receiver 74 is electrically connected to the processor 112 by a data bus 74*a*. The light 83 above the beer keg 84 is electrically connected to the processor 112 by a data bus 83*a*. The depletion sensor 183 is electrically connected to the processor 112 by a data bus 183*a*. The general location of the spigot 90 having a back portion 90*b* is shown on the pumping device 110.

Figure 4:
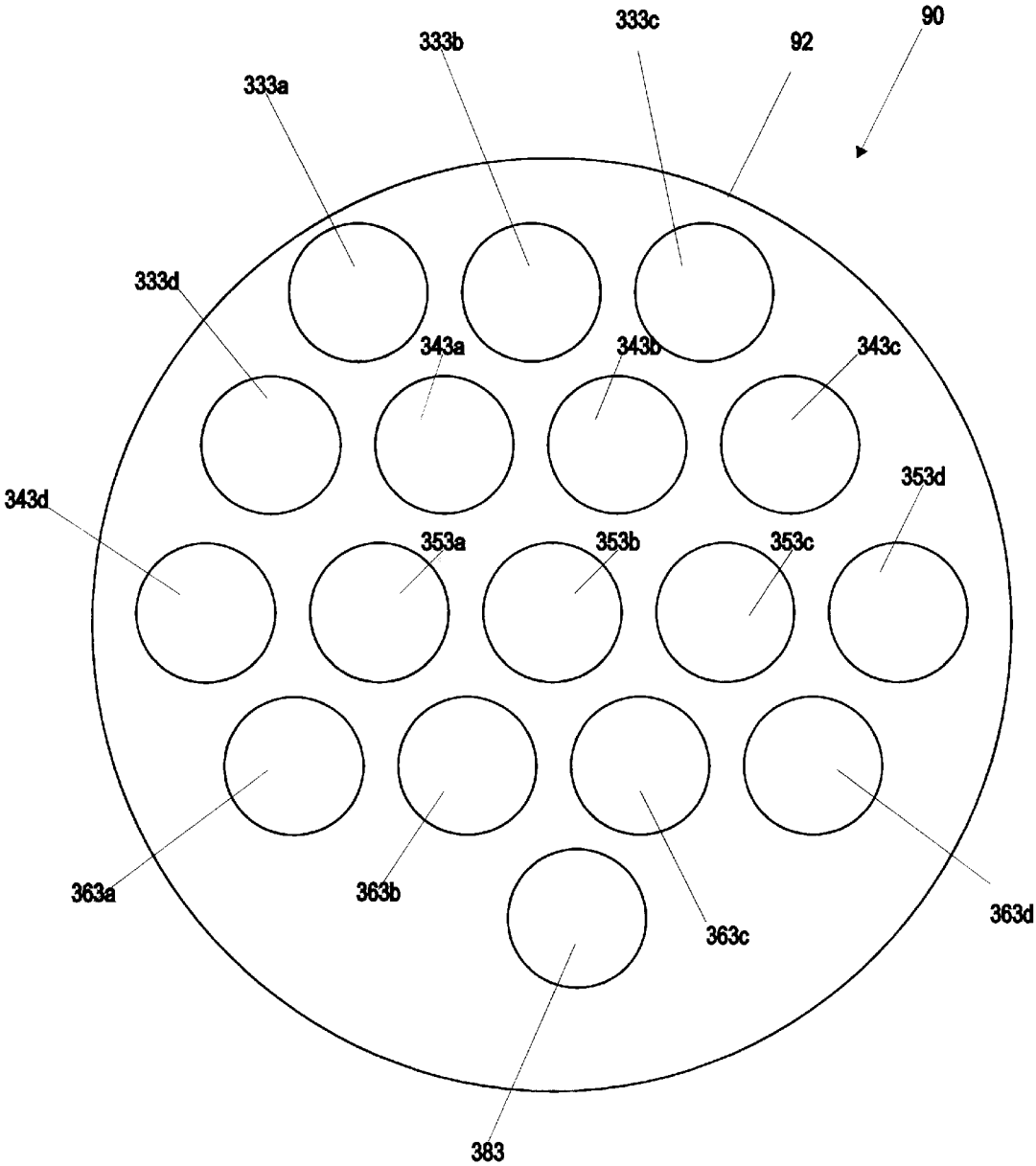
FIG. 4 shows a spigot having a plurality of openings for dispensing beverages for use with the embodiment of FIG. 1.

FIG. 4 shows the surface 92 of the spigot 90. The surface 92, has a plurality of openings for dispensing beverages for use with the embodiment of FIG. 1. Each opening corresponds to one of the tubes connected to the beverage bottles or containers. FIG. 4 shows openings 333*a–d*, 343*a–d*, 353*a–d*, 363*a–d*, and 383. Openings 333*a–d*, 343*a–d*, 353*a–d*, 363*a–d*, and 383 are connected to tubes 33*a–d*, 43*a–d*, 53*a–d*, 63*a–d*, and 83 respectively. The pumping device 110 may include a valve inside of each of tubes 33*a–d*, 43*a–d*, 53*a–d*, 63*a–d*, and 83 for precisely controlling the delivery of a beverage. These valves can be controlled by the processor 112 by the processor sending appropriate control signals to via the data bus 110*a* to the pumping device 110 identifying the valve to be opened closed. The plurality of openings shown in FIG. 4 could be replaced by a single opening and the pumping device 110 in that embodiment would simply control which beverage goes to the single opening.

Figure 5:
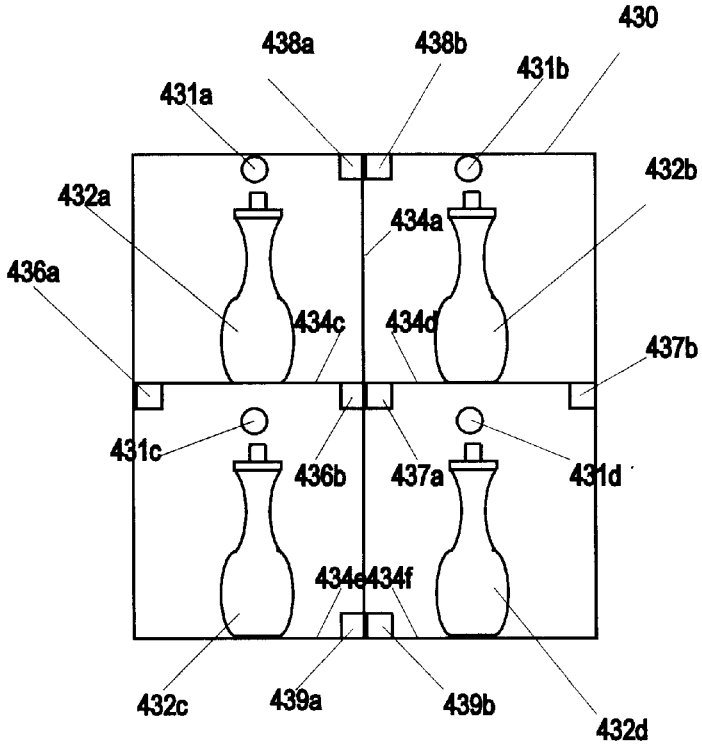
FIG. 5 shows a compartment wherein a plurality of shelves have been placed in a first configuration.
Figure 6:
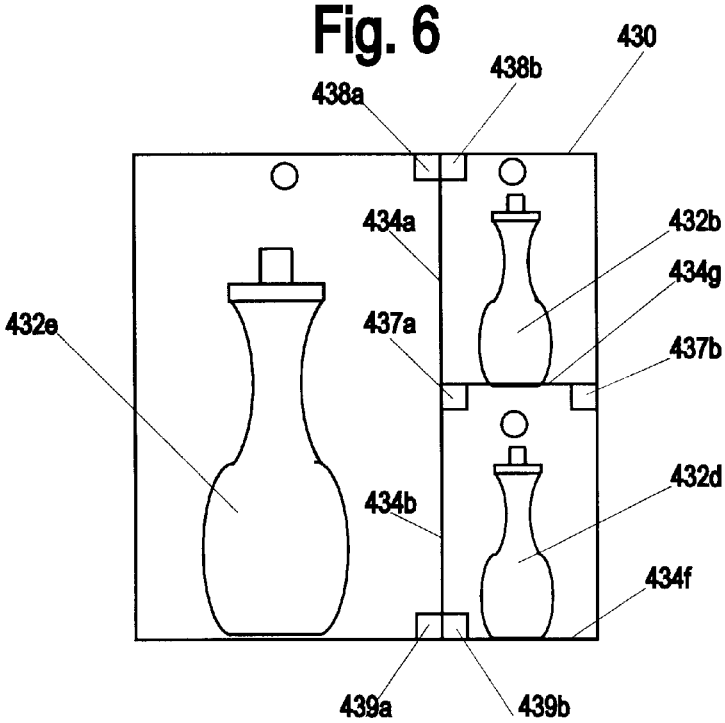
FIG. 6 shows the compartment of FIG. 6 wherein a plurality of shelves have been placed in a second configuration.

FIG. 5 shows a compartment 430 wherein a plurality of shelves have been placed in a first configuration. The compartment 430 can be placed in the location of compartment 30 in FIG. 1. The compartment 430 includes vertical shelf 434*a* and 434*b*, and shelves 434*c*, 434*d*, 434*e*, and 434*f*. The shelves 434*a* and 434*b* may actually be one shelf and may be held in position in FIG. 5 by pegs 438*a*, 438*b*, 439*a*, and 439*b*. The shelf 434*c* may be held in place by pegs 436*a* and 436*b*. The shelf 434*d* may be held in place by pegs 437*a* and 437*b*. The shelves 434*e* and 434*f* may be fixed. In FIG. 6, four wine bottles: 432*a*, 432*b*, 432*c*, and 432*d* are shown, which are of the same size.

FIG. 6 shows the compartment 430 of FIG. 5 wherein a plurality of shelves have been placed in a second configuration. Shelves 434*a* and 434*b* have been moved to the right along with the pegs 438*a–b* and 439*a–b* that support shelves 434*a* and 434*b*. Shelf 434*c* has been taken out of the compartment 430. A shorter shelf 434*g* has been added and pegs 437*a* and 437*b* have been moved. FIG. 6 shows a large wine bottle 432*e* and two smaller wine bottles 432*b* and 432*d*.

Figure 7:
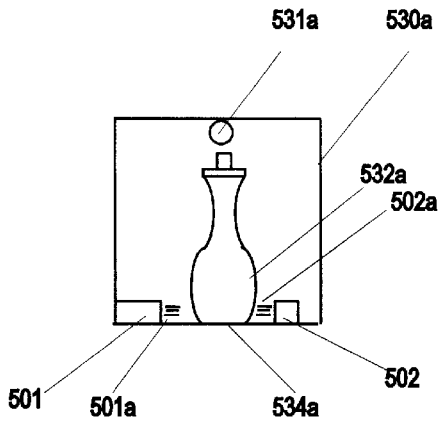
FIG. 7 shows an example of a depletion sensor device for use with the embodiment of FIG. 1

FIG. 7 shows an example of a portion of a depletion sensing device for use with the embodiment of FIG. 1. A cubicle 530*a* is shown in FIG. 7 which may be placed in the FIG. 1 embodiment, for example as a type of or a substitute for cubicle 30*a*. Cubicle 530*a* includes a light source 501 and a light sensor 502 located at the bottom shelf 534*a* of cubicle 530*a*. The light source 501 emits light 501*a* which to some degree passes through the bottom of the bottle 532*a* and comes out on the other side as light 502*a*, and is received by light sensor 502. The depletion sensing device may be thought of as being comprised of at least the light source and the light sensor 502. If a threshold amount of light is received at light sensor 502 it means that the bottle is empty, since the present of liquid may have a tendency to diminish the amount of light transmitted. There are other methods and techniques known in the art for detecting depletion or the absence or approximate absence of liquid in bottle 532*a*. another example might be an embedded weight sensor in shelf 534*a*. When the weight is below a threshold it would indicate to the processor 112 that the liquid has been depleted.

Figure 8:
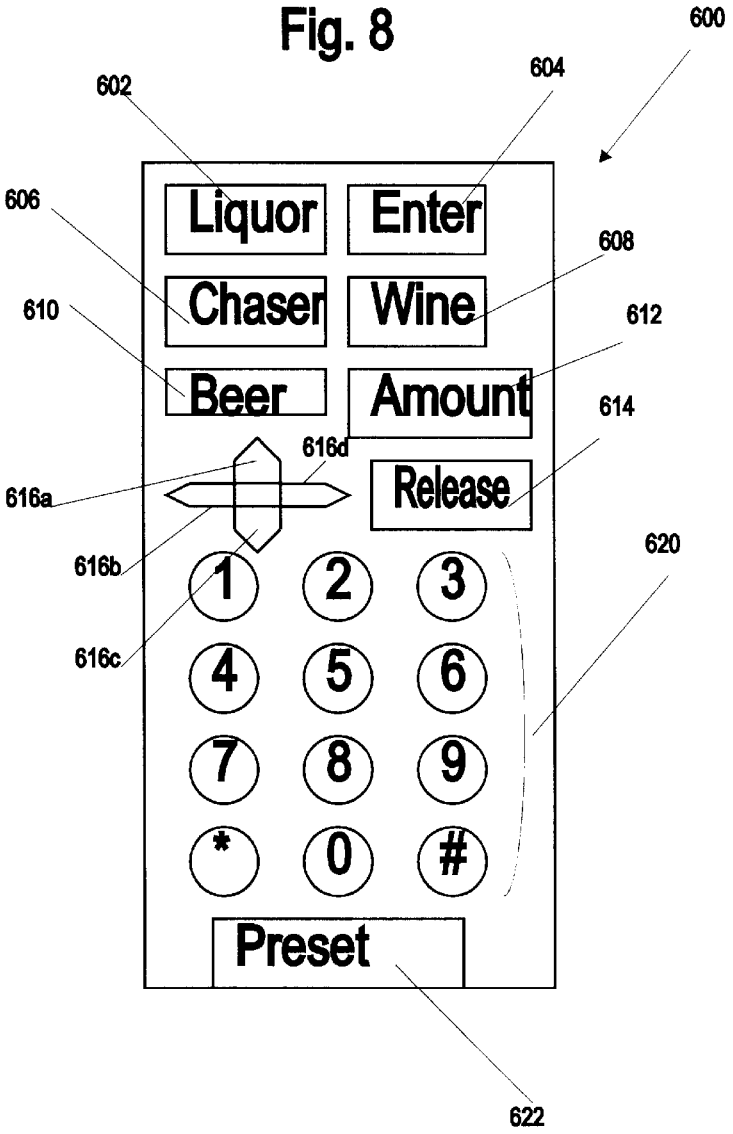
FIG. 8 shows a remote control for controlling the dispensing of beverages by the apparatus of FIG. 1.

FIG. 8 shows a remote control 600 for controlling the dispensing of beverages by the apparatus of FIG. 1. The remote control 600 may emit light signals or ultrasonic frequency signals or any other known remote control signals. The remote control 600 may include "Liquor" button 602, "Enter" button 604, "Chaser" button 606, "Wine" button 608, "Beer" button 610, "Amount" button 612, "Release" button 614, arrow buttons 616*a–d,* keypad 620, and preset button 622.

Figure 9:
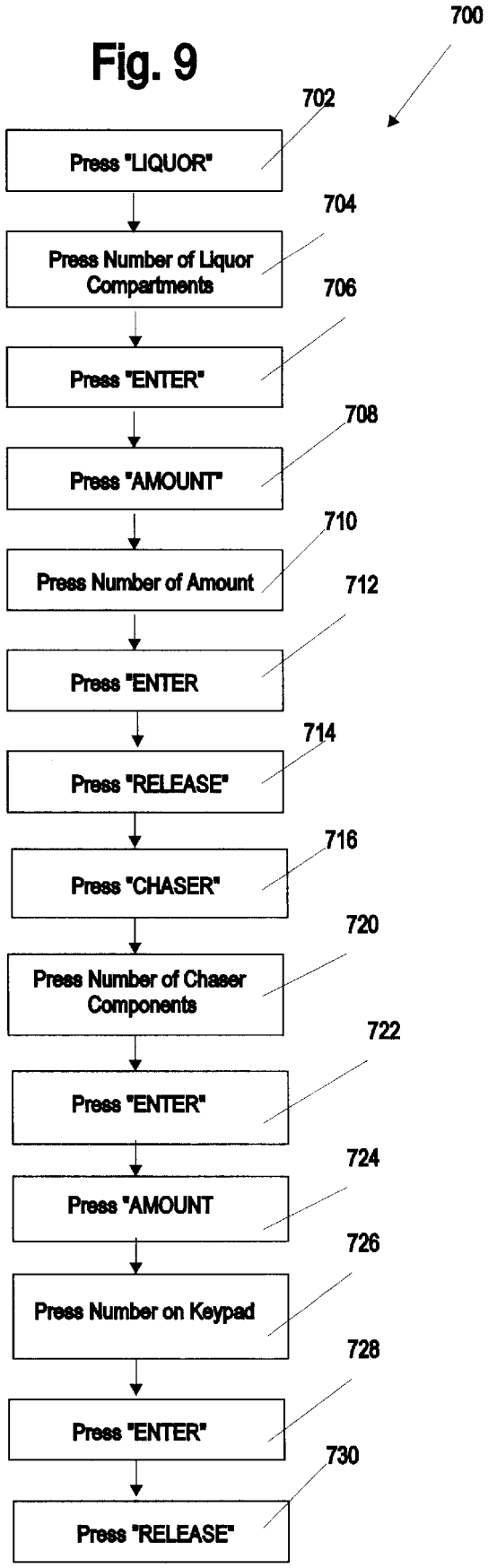
FIG. 9 shows flow chart of a method of dispensing beverages in accordance with an embodiment of the present invention.

FIG. 9 shows flow chart 700 of a method of dispensing beverages in accordance with an embodiment of the present invention. At the first step 702, an operator presses the "Liquor" button 602 on the remote control 600. This identifies the "Liquor" compartment 40 shown in FIG. 1. At the second step 704, the operator presses the number or combination of numbers of the specific liquor cubicle on the keypad 620 of the remote control 600. For example, the operator may press "1" which may identify the cubicle 40*a* shown in FIG. 1. At step 706, the operator may then press the "Enter" button 604. Pressing the "Enter" button 604 will cause a first control signal to be emitted from the remote control 600 to the control signal receiver 74. The control signal receiver 74 received the first control signal and sends it via data bus 74*a* to the processor 112. The processor 112 then sends a signal to light 41*a* to turn on the light 41*a* in the cubicle 40*a* of the "Liquor" compartment 40 shown in FIG. 1.

If the operator is satisfied with his selection, the operator may next press the "Amount" button 612 on the remote control 600 at step 708. The operator may next press a number for an amount such as "1" for one ounce, at step 710. The operator may next press the "Enter" button 604 at step 712 which will cause a second control signal to be emitted from the remote control 600 to the control signal receiver 74. The control signal receiver 74 sends the second control signal to the processor 112, which sets an internal timer corresponding to how much liquor is to be dispensed from bottle 42*a* in cubicle 40*a*. At step 714, the operator presses the "Release" button 614 which sends a third control signal to the control signal receiver 74, which provides it to the processor 112. The processor 112 then causes a valve in the tube 43*a* for bottle 42*a* to be opened and thereafter causes the pumping device to draw and/or pump liquid from the bottle 42 into the tube 43*a* and through the opening 343*a* of the spigot 90 shown in FIG. 4. A glass should be located under the spigot surface 92 shown in FIG. 1, into which the liquid from bottle 42*a* is dispensed.

An operator may then decide that he or she also wants a "chaser" to be added to his or her drink. At step 716, an operator presses the "Chaser" button 606 on the remote control 600. This identifies the "Chaser" compartment 60 shown in FIG. 1. At the next step 720, the operator presses the number or combination of numbers of the specific chaser cubicle on the keypad 620 of the remote control 600. For example, the operator may press "1" which may identify the cubicle 60*a* shown in FIG. 1. At step 722, the operator may then press the "Enter" button 604. Pressing the "Enter" button 604 will cause a first control signal to be emitted from the remote control 600 to the control signal receiver 74. The control signal receiver 74 receives the first control signal and sends it via data bus 74*a* to the processor 112. The processor 112 then sends a signal to light 61*a* to turn on the light 61*a* in the cubicle 60*a* of the "Chaser" compartment 60 shown in FIG. 1.

If the operator is satisfied with his selection, the operator may next press the "Amount" button 612 on the remote control 600 at step 724. The operator may next press a number for an amount such as "1" for one ounce, at step 726. The operator may next press the "Enter" button 604 at step 728 which will cause a second control signal to be emitted from the remote control 600 to the control signal receiver 74. The control signal receiver 74 sends the second control signal to the processor 112, which sets an internal timer corresponding to how much liquor is to be dispensed from bottle 62*a* in cubicle 60*a*. At step 730, the operator presses the "Release" button 714 which sends a third control signal to the control signal receiver 74, which provides it to the processor 112. The processor 112 then causes a valve in the tube 63*a* for bottle 62*a* to be opened and thereafter causes the pumping device 110 to draw and/or pump liquid from the bottle 62*a* into the tube 63*a* and through the opening 363*a* of the spigot 90 shown in FIG. 4. The glass with the liquor should be located under the spigot surface 92 shown in FIG. 1, into which the liquid from bottle 62*a* is dispensed. Thus a mixed drink comprised of a hard liquor from cubicle 40*a* of compartment 40 has been prepared with a chaser from cubicle 60*a* of compartment 60.

An operator may select any other beverage in compartments 30, 40, 50, 60, and 80 in a similar manner. In each case the light inside the particular cubicle of the particular compartment (i.e. one of lights 31*a–d*, 41*a–d*, 51*a–d*, 61*a–d*, or 83) goes on to indicate that the particular beverage has been selected. If the processor 112 has detected that a particular beverage has been depleted, the processor 112 may activate the appropriate light of lights 31*a–d*, 41*a–d*, 51*a–d*, 61*a–d*, or 83 in a different color from when it that beverage is selected. For example "red" may indicate selection while "blue" may indicate depletion. The processor 112 may check whether a beverage or bottle is depleted before opening the appropriate valve or turning on the pumping device 112. If the bottle has been depleted then the appropriate valve will not be opened and the pumping device 112 will not be activated.

The liquor bottles and chaser bottles may vary in size. For example a one liter bottle of coke to a three liter bottle of coke. The liquor bottles may vary similarly. For example from a one quart container to a three quart container. These compartments will be adjustable to where a larger bottle would be held in a compartment simply by sliding the sides of the compartment in or out, such as in towards each other or out away from each other.

Each apparatus like apparatus 10 of an embodiment of the present invention may come equipped with for example seven compartments, or ten compartments, or fifteen compartments or larger depending on consumer home usage or commercial usage (such as bars, restaurants, etc.) or the size of the commercial usage.

An adaptable water hose connection may be provided when there is an independent water source. Basically the apparatus 10 (also called "auto bar") could be connected to regular household plumbing for water which may be connected to the ice and water making device 70 and also provide water to the device 70. Alternatively, a five gallon bottle of water (for example) can be provided with a suction straw hose connection to the ice and water making device 70. This five gallon bottle of water may be located at the base or bottom of the apparatus 10 in a closed in area, with a lock, similar to the beer keg compartment 80 shown in FIG. 1. The five gallon bottle of water may be replenished it is empty.

These units may use a double reflection mirror to make the upside down bottles and labels appear to be upright to an operator. When the bottles are upside down in FIG. 1, gravity may be used for dispensing of liquid and in some cases the suction or pumping device 110 may not be needed. The user might insert a tube, like tube 33*a*, into a bottle, like wine bottle 33*a*. The tube 33*a*, may include on the end of it a cap. Each cap may include a stop gap device, which can be selected and opened by the processor 112. The remote control 600 could be used to select a certain amount of liquor from wine bottle 33*a* by causing the opening of a valve, which can also be called a stop gap device in tube 33*a*. The apparatus 10 may be able to, for example, dispense an amount such as one, two, or three shot glasses. Or a user may hold the release button (like release button 614) on remote control 600 until the glass or glasses are filled.

The compartments, such as the beer compartment 50 and the wine compartment 30, may be refrigerated. When refrigeration is used, there may be, for example a beer bottle or can (such as beer can 52*a*) which can be seen from the front of the apparatus 10 as seen in FIG. 1, while cold beer from which the beer is actually dispensed is hidden inside the apparatus 10. In this situation the tubes such as tube 53*a* would not be connected to the visible beer cans, such as can 52*a* but rather would be connected to refrigerated containers of beer inside the apparatus 10.

A mechanism can be provided for opening the bottles, such as bottles 32*a*–32*d* and then automatically inserting the tubes, such as tubes 33*a*–33*d* to suction the liquid from each bottle. Beer bottles and cans dispensing from the apparatus 10 may employ a moving suction straw hose tube (for tubes such as tube 33*a*) with opener which may first open the bottles or cans and then insert the tubes such as tube 33*a*. Suction may then be provided by pumping device 110 shown in FIG. 1 (if that liquid is selected).

A glass holder 91 may be provided having a top surface 91*a*. A distance D1 may exist between the top surface 91*a* and bottom of spigot opening 92. A glass may be placed on the top surface 91*a* of the holder 91 so that it lies underneath the spigot opening 92. The holder 91 can be adjustable, so that distance D1 may be adjustable, so that different sizes glasses may be placed on it. Glasses or chilled liquid bottles (such as cans of beer) may be directly dispensed to the top surface 91*a* of the holder 91.

A larger embodiment can be provided which includes glass washing and dispensing device 76, while a smaller embodiment may not contain a device 76. The glasses can be washed and stored cold in the device 76 for easy dispensing of chilled glasses at user request, i.e. device 76 may be refrigerated. Depending on unit price these glasses could be made to eject from cold storage areas within the apparatus 10 of FIG. 1 and go directly under spigot 72 for dispensing of liquid. The glass washing part of device 76 may be similar to a regular dishwasher except it may only wash glasses. The device 76 can be located at the base of the apparatus 10. The device 76 may include a rack on which a full load of glasses is placed. After the full load of glasses have been washed, the device may push the glasses automatically to a cold storage area of the device 76. The device 76 would typically be for larger commercial establishments such as for uses in bars, hotel rooms, minibars and restaurants. These drinks would also tabulate how many drinks are used by the system so managers and bar owners could calculate and tabulate each night's receipts in a cash register versus what was served by the apparatus 10 (the "auto bar").

The spigot 90 may include a light, such as a laser light 93*a*, electrically connected to processor 112 which shoots down from opening 92 towards the surface 91*a* of glass holder 91 as light ray 93*c*. The surface 91*a* may include a light detector 93*b* electrically connected to processor 112 in FIG. 3. If a glass is not directly under the laser light or for example upside down the light detector 93*b* on surface 91*a* would detect that there is light being received at the detector 93*b*. If no light is received, then the glass is said to be present and properly positioned. The processor 112 may also provide a message to position the glass properly through a speaker or a video display on apparatus 10. If the glass is removed from glass holder 91 then the processor 112 would stop the pouring of the liquid into the glass by detecting that light is being received at the light detector 93*b* on surface 91*a*. Pouring of the liquid may be stopped, for example by closing a valve in tube 33*a*, or may be rerouted to a waste pipe or washed down a drain connected to the apparatus 10. The glass holder 91 would be connected to a waste line, which routes liquid spilled or wasted into a plumbing system or sewerage system. For smaller systems, the glass holder 91 may be a simple tray to catch spilled liquid.

There may be more than one spigot, similar to spigot 72, and drinks could be dispensed from more than one spigot or opening. The single remote control 600 may be used to dispense liquids from more than one spigot by entering a code for the particular spigot to dispense from.

A security lock may be provided by entering a code into the remote control 600 so that no alcoholic beverages may be permitted to be dispensed, i.e. no wine from compartment 30, beer from compartment 50, or hard liquor from compartment, only non-alcohol chasers from compartment 60.

The ice may be provided at the same site as the liquids directly underneath the spigot 72. After a user selects, for example, a liquor and a chaser, the user may select ice by using the remote control 600.

There may be preset combinations for different drinks. For example there may be a preset code for a "Screw Driver" drink. For a preset the operator may, for example, enter a number into remote control 600, then press the preset button 622, and then press the release button 614.

The control signal receiver 74 may be responsive to a voice command for dispensing a liquid from spigot the 72 from one or more of bottles or cans from compartments such as compartments 30, 40, 50 or 60. The voice terminology for different drink requests is often distinct so it may not be difficult for the control signal receiver 74 (if voice responsive) to response to differentiate such requests. The verbal commands could also be numbers, one each corresponding to a particular bottle of liquor or can of liquor in a particular compartment. For example a Rum bottle may be designated as number "1" and the user may say "1" to select the rum bottle. Vodka could be designated as number "2", gin as number "3", scotch as number "4", and brandy as number "5" for example. The chaser drinks, such as coca cola "7" could also be selected by a voice command specifying a number. After the user speaks the number or a combination of numbers (such as "1" and "7" for rum and coke) the user may next specify verbally the specific amount of each liquid for the apparatus 10 to deliver, such as for example by saying "shot". At that point the processor 112 will cause a "shot" glass worth of liquid (which is typically a standard amount) will be delivered through spigot 72. The liquids, such as particularly the chasers, may also be dispensed using verbal commands, such as "light", "medium", or "heavy", to indicates whether a "light" amount, "medium" amount, or "heavy" amount of chaser is desired. These verbal commands may cause the processor 112 to deliver a correct amount of chaser.

I claim:

1. An apparatus comprising:

a plurality of liquid containers each having an opening;

a plurality of tubes each having a first end and a second end, the first end of each tube inserted into a corresponding opening of a corresponding liquid container;

a pumping device connected to the second end of the plurality of tubes;

a processor electrically connected to the pumping device;

wherein the processor in response to a first signal selects a first liquid container of the plurality of liquid containers and causes the pumping device to cause liquid to be sucked and pumped out of the first liquid container through its opening through the first end of the corresponding tube and out the second end of the corresponding tube;

and wherein each of the plurality of liquid containers is behind a transparent door and can be seen through the transparent door.

2. The apparatus of claim 1 wherein the plurality of liquid containers is comprised of a first set of liquid containers each of which contains wine.

3. The apparatus of claim 2 wherein the plurality of liquid containers is comprised of a second set of liquid containers each of which contains beer.

4. The apparatus of claim 3 wherein the plurality of liquid containers is comprised of a third set of liquid containers each of which contains hard liquor.

5. The apparatus of claim 1 wherein the plurality of liquid containers is comprised of a first set of liquid containers each of which contains hard liquor.

6. The apparatus of claim 1 wherein the plurality of liquid containers is comprised of a first set of liquid containers each of which contains a drink chaser.

7. The apparatus of claim 1 wherein the plurality of liquid containers is comprised of a first set of liquid containers each of which contains beer.

8. The apparatus of claim 1 further comprised of a housing; and wherein the plurality of liquid containers are stored in the housing.

9. The apparatus of claim 8 wherein the housing includes a plurality of cubicles, each cubicle containing one of the plurality of liquid containers.

10. The apparatus of claim 1 further comprised of a remote control signal receiver which is electrically connected to the processor and which supplies the processor with the first signal in response to a remote control signal.

11. The apparatus of claim 10 wherein the housing is comprised of a plurality of compartments including a first compartment having a first set of liquid containers which contain wine; and a second compartment having a second set of liquid containers containing hard liquor.

12. The apparatus of claim 1 further comprised of a plurality of selection lights, one for each corresponding liquid container of the plurality of liquid containers, and wherein a first light of the plurality of selection lights turns on when the corresponding first liquid container is selected.

13. The apparatus of claim 12 further comprised of a remote control signal receiver which is electrically connected to the processor and which supplies the processor with the first signal in response to a remote control signal.

14. The apparatus of claim 12 wherein the housing is comprised of a plurality of compartments including a first compartment having a first set of liquid containers which contain hard liquor; and a second compartment having a second set of liquid containers containing chasers.

15. The apparatus of claim 12 wherein the housing is comprised of a plurality of compartments including a first compartment having a first set of liquid containers which contain beer; and a second compartment having a second set of liquid containers containing hard liquor.

16. The apparatus of claim 1 wherein the processor selects the first liquid container in response to a voice command.

17. An apparatus comprising:

a plurality of liquid containers each having an opening;

a plurality of tubes each having a first end and a second end, the first end of each tube inserted into a corresponding opening of a corresponding liquid container;

a plurality of selection lights, one for each corresponding liquid container of the plurality of liquid containers, a pumping device connected to the second end of the plurality of tubes;

a processor electrically connected to the pumping device;

a plurality of depletion sensing devices, one for each corresponding liquid container of the plurality of liquid containers, wherein the processor in response to a first signal selects a first liquid container of the plurality of liquid containers and causes the pumping device to cause liquid to be sucked and pumped out of the first liquid container through its opening through the first end of the corresponding tube and out the second end of the corresponding tube;

wherein each depletion sensing device is electrically connected to the processor and each depletion sensing device provides an indication of whether its corresponding liquid container has been virtually depleted of liquid;

wherein a first light of the plurality of selection lights provides light of a first color when the corresponding first liquid container is selected; and wherein the first light of the plurality of selection lights provides light of a second color, which is different from the first color, when the corresponding first liquid container has been virtually depleted of liquid.

18. The apparatus of claim 17 further wherein when the processor receives an indication of depletion from a first depletion sensing device for a first liquid container, the processor prevents the pumping device from attempting to pump liquid from the first liquid container.

19. The apparatus of claim 18 further comprised of a remote control signal receiver which is electrically connected to the processor and which supplies the processor with the first signal in response to a remote control signal.

20. The apparatus of claim 17 further comprised of a remote control signal receiver which is electrically connected to the processor and which supplies the processor with the first signal in response to a remote control signal.

21. An apparatus comprising:

a plurality of liquid containers each having an opening;

a plurality of tubes each having a first end and a second end, the first end of each tube inserted into a corresponding opening of a corresponding liquid container;

a plurality of valves connected to each the openings of the liquid containers;

a processor electrically connected to the plurality of valves;

wherein each of the plurality of liquid containers are facing downwards with their respective opening nearest the ground;

wherein the processor in response to a first signal selects a first liquid container of the plurality of liquid containers and causes a corresponding first valve to cause liquid to come out of the opening of a first liquid container by the force of gravity through its opening through the first end of the corresponding tube and out the second end of the corresponding tube.

22. The apparatus of claim 1 wherein the processor selects the first liquid container in response to a voice command.

23. The apparatus of claim 21 further comprising a mirror device which allows each of the plurality of liquid containers which are facing downwards to be seen upright.

a processor electrically connected to the plurality of valves;

wherein each of the plurality of liquid containers are facing downwards with their respective opening nearest the ground;

wherein the processor in response to a first signal selects a first liquid container of the plurality of liquid containers and causes a corresponding first valve to cause liquid to come out of the opening of a first liquid container by the force of gravity through its opening through the first end of the corresponding tube and out the second end of the corresponding tube.

* * * * *

UNITED STATES PATENT AND TRADEMARK OFFICE

CERTIFICATE OF CORRECTION

PATENT NO. : 6,422,422 B1
DATED : July 23, 2002
INVENTOR(S) : Ludlow D. Forbes

It is certified that error appears in the above-identified patent and that said Letters Patent is hereby corrected as shown below:

Column 12,
Line 26, please replace "1" with -- 21 --; and
Lines 33-44, please delete the following:
"a processor electrically connected to the plurality of valves;
wherein each of the plurality of liquid containers are facing downwards with their respective opening nearest the ground;
wherein the processor in response to a first signal selects a first liquid container of the plurality of liquid containers and causes a corresponding first valve to cause liquid to come out of the opening of a first liquid container by the force of gravity through its opening through the first end of the corresponding tube and out the second end of the corresponding tube."

Signed and Sealed this

Second Day of August, 2005

JON W. DUDAS
*Director of the United States Patent and Trademark Office*